United States Patent [19]

Gurkov et al.

[11] 4,063,423

[45] Dec. 20, 1977

[54] METHOD OF MAKING BUILT-IN-PLACE REINFORCED CONCRETE PILES

[76] Inventors: Konstantin Stepanovich Gurkov, ulitsa Derzhavina, 19, kv. 13; Nikolai Grigorievich Nazarov, ulitsa Gogolya, 3, kv. 10; Evgeny Nikolaevich Cherednikov, ulitsa Lenina, 32, kv. 6; Vladimir Dmitrievich Plavskikh, ulitsa Kamenskaya, 84v, kv. 33; Leonid Georgievich Rozhkov, ulitsa Krylova, 41, kv. 40; Khaim Berkovich Tkach, ulitsa Gogolya, 17, kv. 49; Vladimir Alexandrovich Grigoraschenko, ulitsa Voskhod, 7, kv. 67; Alexandr Dmitrievich Kostylev, ulitsa Derzhavina, 19, kv. 44; Vasily Georgievich Davydov, ulitsa Saltykova-Schedrina, 9, kv. 28; Valentin Alexeevich Zuev, ulitsa Sovetskaya, 53, kv. 50, all of Novosibirsk, U.S.S.R.

[21] Appl. No.: 577,746

[22] Filed: May 15, 1975

[51] Int. Cl.[2] ..... E02D 5/34; E02D 5/48

[52] U.S. Cl. ..... 61/53.62; 61/56.5

[58] Field of Search ..... 61/56.5, 56, 53.52, 61/53.6, 53.62, 53.64, 53.66, 35; 52/646, 641

[56] References Cited

U.S. PATENT DOCUMENTS

| | | | |
|---|---|---|---|
| 887,175 | 5/1908 | Abbott | 61/53.62 X |
| 918,715 | 4/1909 | Wedmore | 52/646 X |
| 1,157,442 | 10/1915 | Stewart | 61/53.64 |
| 1,654,600 | 1/1928 | Powell | 61/53.64 |

FOREIGN PATENT DOCUMENTS

| | | | |
|---|---|---|---|
| 474,362 | 11/1914 | France | 61/53.52 |

*Primary Examiner*—Jacob Shapiro

[57] ABSTRACT

Method consisting in forming a borehole in the ground preferably having a diameter smaller than the desired diameter of a pile, compacting a concrete mix poured into the borehole by repeatedly passing a pneumatic mole through the borehole filled with concrete to compact the concrete mix in the peripheral zone of the borehole thereby concurrently expanding the reinforcement.

3 Claims, 6 Drawing Figures

III
III

METHOD OF MAKING BUILT-IN-PLACE REINFORCED CONCRETE PILES

FIELD OF THE INVENTION

The invention relates to the manufacture of structural members, and more specifically it concerns the method of making built-in-place reinforced concrete piles to be used in constructing pile foundations, consolidating earth slopes and the like.

BACKGROUND

It is widely known to make built-in-place reinforced concrete piles by a method wherein a borehole is formed in the ground by using any appropriate equipment and then a reinforcement is placed in the borehole. Subsequently, the borehole is filled with a concrete mix which is then positively compacted by means of vibrators to obtain a pile.

In making the borehole in the ground, the borehole diameter is always determined by the desired diameter of the pile. As the drilling of vertical and inclined boreholes is always associated with the employment of cumbersome equipment, the construction of large diameter piles (more than 300 mm) requires much labor and completely excludes any opportunity of working in rather inaccessible places (e.g. when making pile foundations in expanding factory buildings or on other sites occupied by buildings, as well as in consolidating railway beds).

In addition, during the placing of concrete in the borehole and compacting the concrete mix, the reinforcement tends to be displaced from the desired position so that the load-carrying capacity of the pile is considerably reduced.

Ensuring the desired strength of structures to be built requires the number of piles used to be increased, or the piles to be made more bulky.

SUMMARY OF THE INVENTION

It is the main object of the invention to provide a method of making built-in-place reinforced concrete piles which ensures the provision of piles having an increased load-carrying capacity, permits operation at any place, including barely accessible sites, with the employment of mobile equipment.

Another object of the invention is to provide a method of making built-in-place reinforced concrete piles having a maximum possible load-carrying capacity which is especially important in constructing pile foundations withstanding horizontal loads.

Still another object of the invention is to provide a method of making built-in-place reinforced concrete piles having an improved corrosion resistance and prolonged service life.

These and other objects are accomplished in a method of making built-in-place reinforced concrete piles, comprising the steps of: forming a borehole in the ground of a diameter smaller than the diameter of the pile to be built, placing a reinforcement in the borehole, filling the borehole with a concrete mix, and subsequently repeatedly passing a pneumatic mole through the borehole filled with the concrete mix for enlarging the borehole to obtain the desired diameter thereof, whereby the concrete mix and the earth around the borehole are compacted in the radial direction.

The pile reinforcement may comprise a frame which is deformed in the transverse direction prior to the installation in the borehole.

The frame preferably comprises a reeled metal network.

The internal cavity remaining after the extraction of the pneumatic mole is preferably filled with the concrete mix.

The invention essentially consists in the following. Due to the fact that the compaction of the concrete mix in the borehole is effected by repeatedly passing the pneumatic mole therethrough, an intensive compaction of the concrete mix takes place in the radial direction with respect to the borehole to form a concrete envelope inside the borehole.

While being compacted, the concrete transmits the compacting force to the ground in the peripheral zone of the borehole, thus enlarging it. This permits making a borehole of a considerably smaller diameter as compared to the desired diameter of the pile so that lightweight portable equipment may be used for that purpose. Thus, after 4–5 passes of the pneumatic mole through the borehole filled with a concrete mix having a diameter of 130 mm, a pile having a diameter from 230 to 250 mm can be formed.

This in turn permits building reinforced concrete piles in otherwise inaccessible places.

The concrete mix, which is radially displaced during the compaction, entrains the reinforcement and secures it in the desired position, as the degree of compaction increases, thus it in the design position, thus providing for a high load-carrying capacity of the pile.

In certain cases, where pile foundations are to withstand horizontal loads, the pile is reinforced with a cylindrical frame. The frame may be laced or it may be made of a metal net. Frames of such type are deformed in the transverse direction prior to the installation in the borehole. Thus, laced cylindrical frames are simply compressed at the sides, and frames made of a metal net are reeled. This provides for a more reliable and accurate location of the reinforcement in the desired position and improves the load-carrying capacity of the piles which thus withstand horizontal load.

Where piles are to be built in weak water-saturated ground or in an aggressive environment, the internal cavity remaining after the extraction of the pneumatic mole is filled with a concrete mix to seal the pile. This improves the corrosion resistance of the pile and prolongs its service life.

BRIEF DESCRIPTION OF THE DRAWING

The invention will now be described in greater detail with reference to a specific, exemplary embodiment thereof illustrated in the accompanying drawings, in which.

DETAILED DESCRIPTION

Figures 1, 2, 3, 4, 5, 6:
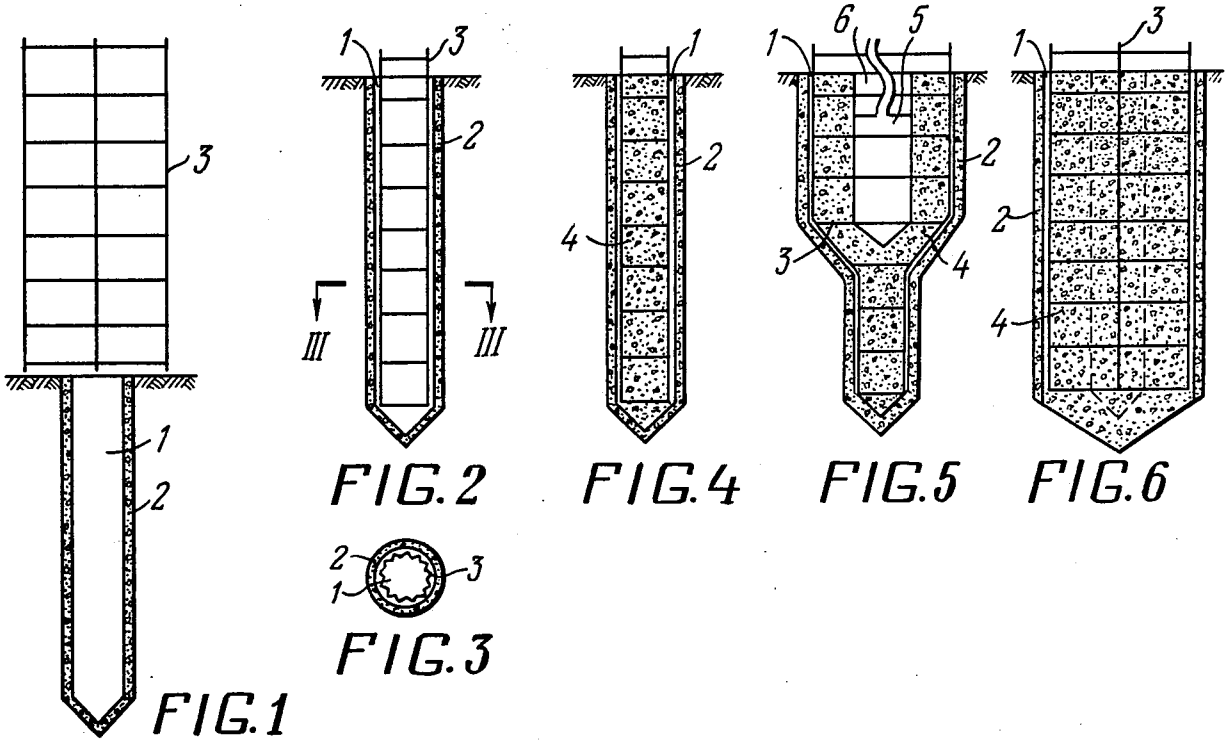
FIG. 1 is a longitudinal section of a borehole and a reinforcement frame placed over the borehole.
FIG. 2 is a longitudinal section of the same borehole with the reinforcement frame, deformed in the transverse direction, installed in the borehole.
FIG. 3 is a sectional view taken along the line III—III in FIG. 2.
FIG. 4 is a longitudinal section of the same borehole after filling it with a concrete mix.
FIG. 5 is a longitudinal section of the same borehole during the compaction of the concrete mix.
FIG. 6 is a longitudinal section of the finished pile.

The method of making pile consists in the following.

First a borehole 1 (FIGS. 1–6) is formed in the ground using any appropriate equipment intended for this purpose, e.g. a pneumatic mole 5.

In accordance with the above considerations, the borehole diameter is selected to be smaller by 20–40% than the desired diameter of the pile being built. Then the borehole 1 is filled with a dry concrete mix with a moisture content of up to 16% by weight, and subsequently the mix is distributed over the borehole walls with a single pass of the pneumatic mole to form a protective concrete layer 2 therein. A reinforcement in the form of a tubular frame 3 is installed in the borehole 1 until the protective concrete layer has enough time to set.

The reinforcement frame may also comprise a net reeled into a tube or single rebars.

The frame 3 should preferably have a diameter larger by 15–30% than the diameter of the initial borehole. Prior to the installation in the borehole 1, the frame is deformed in the transverse direction so that it can pass into the borehole 1. After the installation of the frame 3, the borehole 1 (FIG. 4) is filled with a concrete mix 4 (FIGS. 4–6) which is immediately compacted by means of the pneumatic mole 5 as shown in FIG. 5 which also expands the initial borehole, the pneumatic mole penetrating the concrete mix along the borehole axis in the space within the frame 3.

During the above-described compaction of the concrete mix and concurrent expansion of the initial borehole, and hence of the pile body, the reinforcement is stretched in the transverse direction along with the compaction of the concrete mix so that positioning of the reinforcement in the finished pile is ensured. Furthermore the ground adjacent to the pile walls is compacted, the borehole walls are strengthened, and the pile body is pressed into the ground so that the cohesion between the outer surface of the pile and the ground is improved.

After the completion of concrete compaction, the pneumatic mole 5 is reversed to withdraw it from the pile body.

A cavity 6 (FIG. 5) formed by the pneumatic mole is again filled with the concrete mix, and the pneumatic mole is passed several times until the design pile wall thickness is obtained. Thus, the manufacture of the reinforced concrete pile is completed.

The above-described method is employed for making hollow piles.

In certain cases, where corrosion resistant piles are to be made, the internal space of the pile is filled with a concrete mix as shown in FIG. 6.

What is claimed is:

1. A method of making reinforced concrete piles, comprising forming a borehole in the ground; filling the borehole with a concrete mix; introducing a tool into the filled borehole to compact the mix and form an axial cavity; deforming a tubular reinforcing framing in the radial direction; placing the deformed framing in the axial cavity along its entire length; filling the cavity with a concrete mix and successively axially introducing into and withdrawing from the filled cavity an expanding tool of a size to compact the mix and radially expand the borehole to a predetermined diameter while radially expanding the reinforcing framing.

2. A method according to claim 1, wherein the internal space in the pile is filled with a concrete mix after the last extraction of the expanding tool therefrom.

3. A method according to claim 1, wherein the reinforcement frame comprises a metal net reeled into a tube.

* * * * *